US005107877A

United States Patent [19]

Chipman

[11] Patent Number: 5,107,877

[45] Date of Patent: Apr. 28, 1992

[54] AUTOMATIC BRUSH CLEANER

[76] Inventor: Jimmy M. Chipman, Rte. 3, Box 222A, Latta, S.C. 29565

[21] Appl. No.: 584,247

[22] Filed: Sep. 18, 1990

[51] Int. Cl.[5] ..... B08B 3/04

[52] U.S. Cl. ..... 134/140; 134/159; 206/209

[58] Field of Search ..... 134/135, 140, 157, 158, 134/159, 160, 161, 164, 185, 188, 196; 206/209

[56] References Cited

U.S. PATENT DOCUMENTS

| | | | |
|---|---|---|---|
| 1,254,751 | 1/1918 | Wendelgass | 134/164 |
| 1,285,948 | 11/1918 | Cook | 206/209 X |
| 2,663,604 | 12/1953 | Logan | 134/161 X |
| 2,744,635 | 5/1956 | Hiss | 206/209 X |
| 2,824,029 | 2/1958 | Zinty | 134/161 X |
| 2,853,085 | 9/1958 | Torkelson | 134/161 |
| 2,965,111 | 12/1960 | Fiegelman | 134/135 |
| 3,045,000 | 6/1963 | Hirst | 134/164 |
| 3,116,745 | 1/1964 | Burning . | |
| 3,252,174 | 5/1966 | Schoepske | 15/38 X |
| 4,759,384 | 7/1988 | Kliewer | 134/140 |

*Primary Examiner*—Philip R. Coe
*Attorney, Agent, or Firm*—John L. James

[57] ABSTRACT

A brush cleaning apparatus automatically cleans paint brushes. The device has a frame for supporting an electric motor and a brush holder for holding one or more brushes. The device has a motion translating link. The frame with brushes attached is lowered into a container with a cleaning solution whereby the rotating motion of the motor is translated into pivotal motion of the link to gently agitate the brushes until clean.

18 Claims, 2 Drawing Sheets

AUTOMATIC BRUSH CLEANER

TECHNICAL FIELD

This invention generally relates to an apparatus for cleaning paint implements, and, more particularly, to a device for automatically cleaning paint brushes.

BACKGROUND OF THE INVENTION

When properly used and maintained a modern paint brush provides satisfactory results for a long period of time. Proper care of a brush includes a through, gentle cleaning of the bristles after each use. A brush is quickly damaged or ruined if the paint or other finish is allowed to dry and harden in the bristles. While hardened paint can be removed from the bristles, doing so usually damages the bristles and thereby shortens the life of the brush. The bristles of a paint brush should be cleaned before the paint has hardened or dried. Unfortunately, it is not always convenient to clean the brush immediately following use. To prevent the paint from hardening while awaiting cleaning, many painters will load the brush with paint and wrap the brush in a plastic bag or aluminum foil to keep the bristles moist and pliable. While this practice keeps the bristles moist, it wastes paint and can also damage the bristles. Accordingly, it will be appreciated that it would be highly desirable to quickly and easily clean paint brush bristles immediately after use to thereby eliminate the need to wrap the bristles and reduce the possibility of damage.

High quality paint brushes are not inexpensive items, and, understandably, a painter typically has only one or a few brushes at any given time. Even professional painters have only a select few brushes at any given time. A home owner or other occasional painter will have only one brush for applying paint and perhaps another brush for applying varnish or other finishes. A painter will typically use the same brush to apply all colors of a finish, stopping to clean the brush between colors. It can easily take a painter half an hour or more to clean a brush between colors. Obviously, cleaning the bristles is time consuming and reduces productivity. Accordingly, it will be appreciated that it would be highly desirable to quickly and easily clean paint brush bristles between colors in a short period of time to minimize loss of productivity.

Paint brush bristles are typically cleaned by hand in a solution containing a solvent appropriate for the finish used. When the solvent is mineral spitits, petroleum distillates or other volatile substances, gloves should be worn to avoid harmful contact with the skin. Also, the vapors from the solvents may be hazardous. Thus, cleaning brush bristles is not only messy but may be hazardous as well. Accordingly, it will be appreciated that it would be highly desirable to have a brush cleaner that minimizes splashing of the solvent and minimizes exposure time to the vapors.

Brush cleaners have been devised that eliminate the need for the painter to immerse his hands in the solvent to clean the bristles. These devices typically involve an attachment for electrical drills to which the brush is attached to be spun about in a container of solvent until the brush is clean. Using an electric drill to spin the brushes is messy because the solvent splashes about increasing exposure time to the solvent vapors. Alternatively, the brushes can be spun in the solvent mechanically until clean. Using a mechanical crank is labor intensive and time consuming and increases exposure time to the solvent vapors. It is desirable to have a paint brush cleaner which does not splash the solvent and which operates automatically.

SUMMARY OF THE INVENTION

The present invention is directed to overcoming one or more of the problems set forth above. Briefly summarized, as set forth in one aspect of the present invention, a brush cleaning apparatus comprises a base member with first and second vertical members attached to the base member and extending vertically therefrom. A horizontal member is attached to the vertical members and extends therebetween. A pivot pin is connected to the middle portion of the horizontal member and protrudes therefrom. A link has first and second end portions and a middle portion extending between the end portions, and has an elongated slot engageable with the pivot pin. The link is pivotally movable about the pivot pin. Means are provided for attaching at least one brush to the first end portion of said link. Means are also provided for imparting motion to the second end of the link so that the link pivotally moves about the pivot pin.

It is an object of the present invention to quickly and easily clean paint brush bristles immediately after use to thereby eliminate the need to wrap the bristles and reduce the possibility of damage.

Another object of the invention is to quickly and easily clean paint brush bristles between colors in a short period of time to minimize loss of productivity.

Another object of the invention is to provide a brush cleaner that minimizes splashing of the solvent and minimizes exposure time to the vapors.

Still another object of the invention is to provide a paint brush cleaner which does not splash the solvent and which operates automatically.

Yet another object of the invention is to provide a paint brush cleaner that is easily transported.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 2:
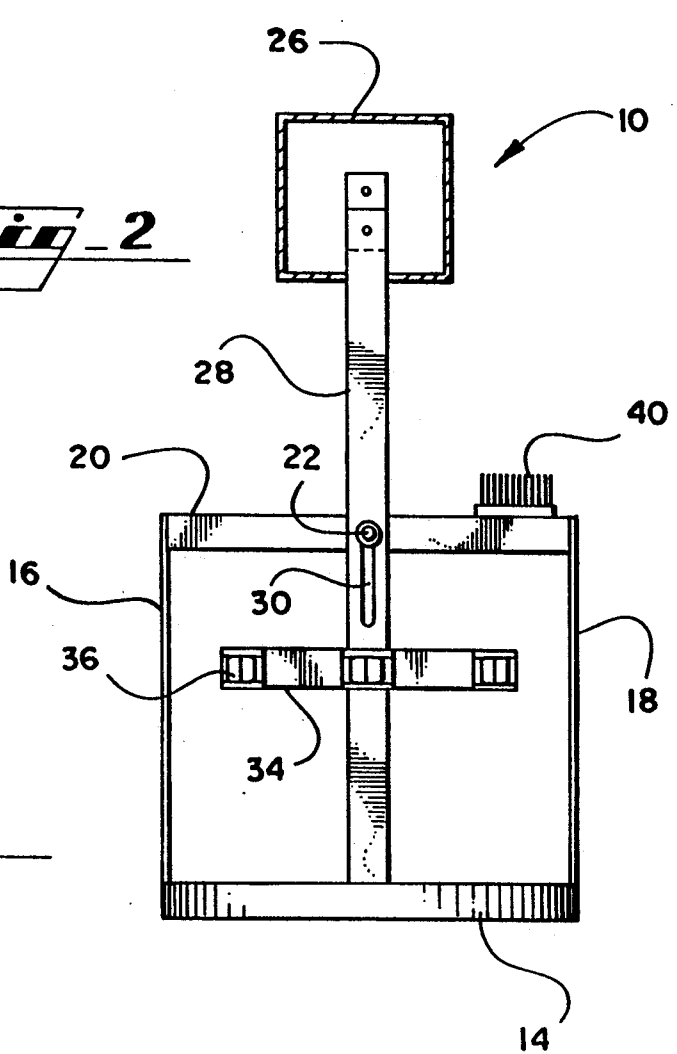
FIG. 2 is a diagrammatic front view of the automatic brush cleaner of FIG. 1.

Referring to FIGS. 1–5, an automatic brush cleaning apparatus 10 includes a frame for holding brushes 12 that is lowered into a container, such as a five gallon paint bucket, for example. The framework is preferably constructed of corrosion resistant metal, such as steel or aluminum, but may be constructed of other strong, durable materials. The framework includes a base member 14 that rests on the bottom on the container. The base member 14 preferably has a circular configuration. First and second vertical members 16, 18 each have one end attached to the base member 14 and extend vertically from the base member 14. When positioned in a paint bucket or other container, the base member 14 rests on the bottom of the container and the vertical members 16, 18 extend along the sidewall on the container. Preferably, the vertical 16, 18 are positioned diametrically opposite one another. A horizontal member 20 is attached to the first and second vertical members 16, 18, and extends therebetween. As illustrated, the horizontal member 20 has its end portions attached to the end portions of the upstanding vertical members 16, 18. A pivot member, such as bolt 22, is attached to the middle portion of the horizontal member 20.

A support member 24 has a first end portion connected to the base member 14, preferably at a location equidistant from the first and second vertical members 16, 18. The first end portion of the support member 24 extends vertically from the base member 14. A second end portion of the support member 24 is connected to the middle portion of the horizontal member 20 by the bolt 22, and extends vertically from the horizontal member 20. A middle portion of the support member 24 extends horizontally between the first and second end portions of the support member 24. A motor 26 is mounted on the horizontal portion of support member 24. Alternatively, the motor 26 may be mounted on the horizontal member 20.

A motion translating link 28 has first and second end portions and a middle portion extending between the first and second end portions. The middle portion of the link 28 has an elongated slot 30 engageable with the bolt 22. The bolt 22 preferably has a head that is wider than the slot 30 that may be equipped with a washer to keep the bolt 22 riding in the slot 30. As an alternative, the second end portion of the support member 24 may be welded to the horizontal member 20 or secured thereto with its own fastener, and the bolt 22 may be a pin that rides in the slot 30.

Figure 1:
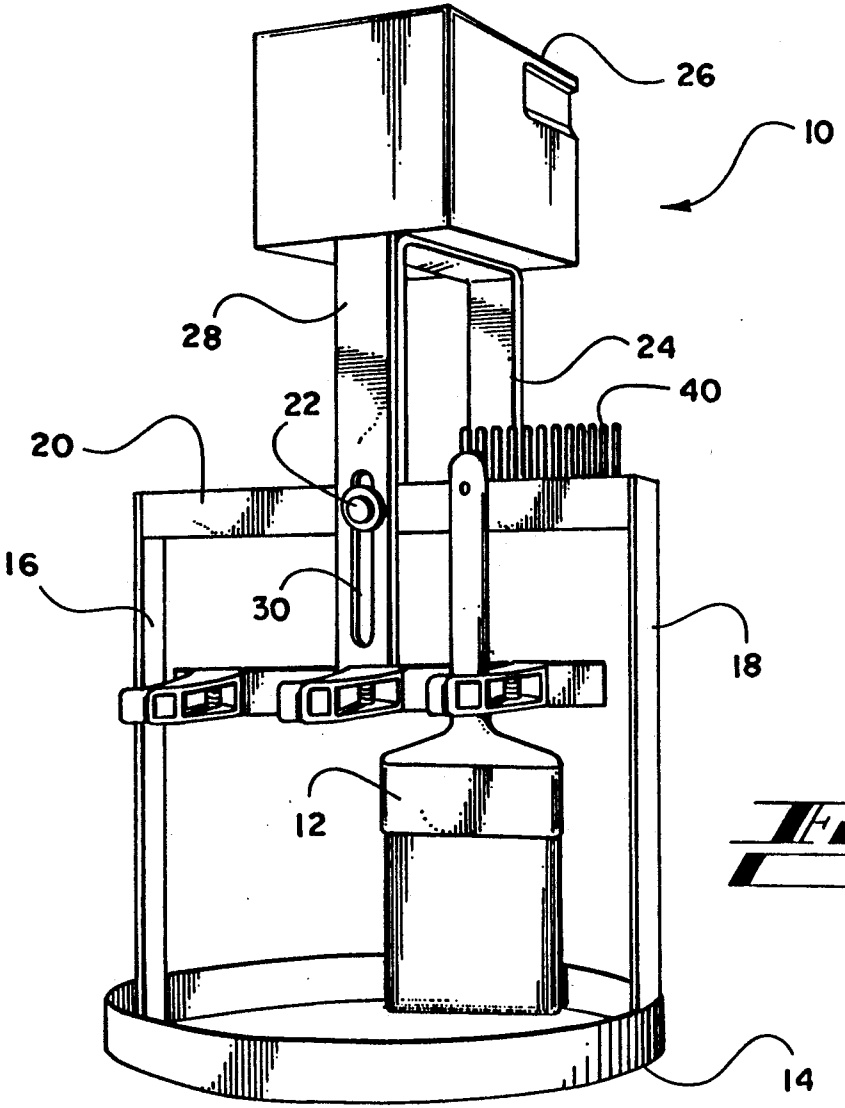
FIG. 1 is a perspective view of a preferred embodiment of an automatic brush cleaner constructed in accordance with the present invention.
Figure 4:
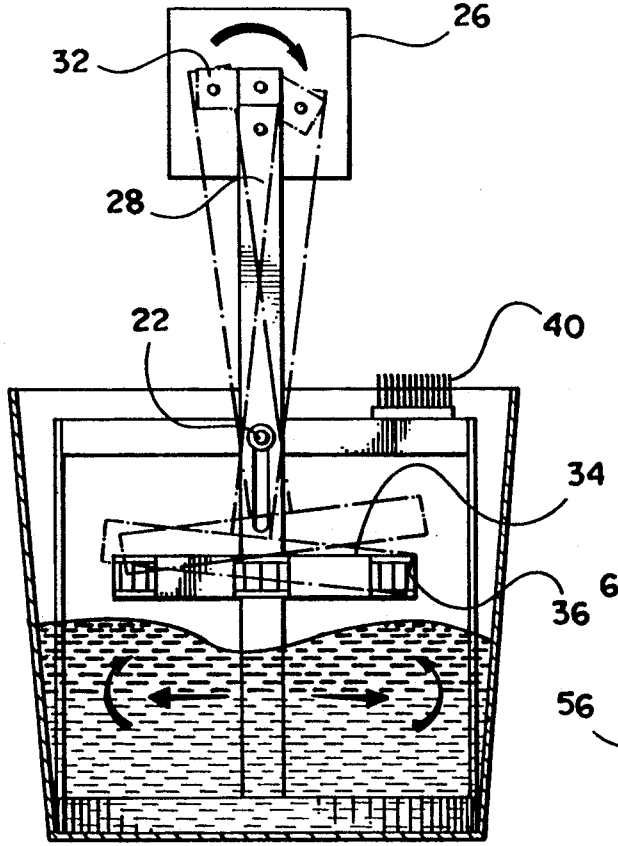
FIG. 4 is diagrammatic front view of the automatic brush cleaner similar to FIG. 2, but illustrating the motion of the brush holders and cleaning solution.

Referring to FIGS. 1 and 4, the upper end portion of the motion translating link 28 is preferably connected to the rotating motor shaft by a short arm or crank 32. The crank 32 rotates with the motor shaft in a circular pattern and imparts motion to the link 28. The upper end of the link 28 at the point of connection to the crank 32 is also a circular pattern. This circular pattern at the upper most end of the link 28 causes the lower middle portion of the link 28 to move up and down and sideways through an angle of about twenty-five degrees as the link 28 pivots about the pivot point 22 via the elongated slot 30.

A horizontal bar 34 is attached to the lower end portion of the link 28 and has one or more clips 36 attached thereto for holding the brushed to be cleaned. Preferably the clips 36 are spring loaded to hold the brushes securely.

Figure 3:
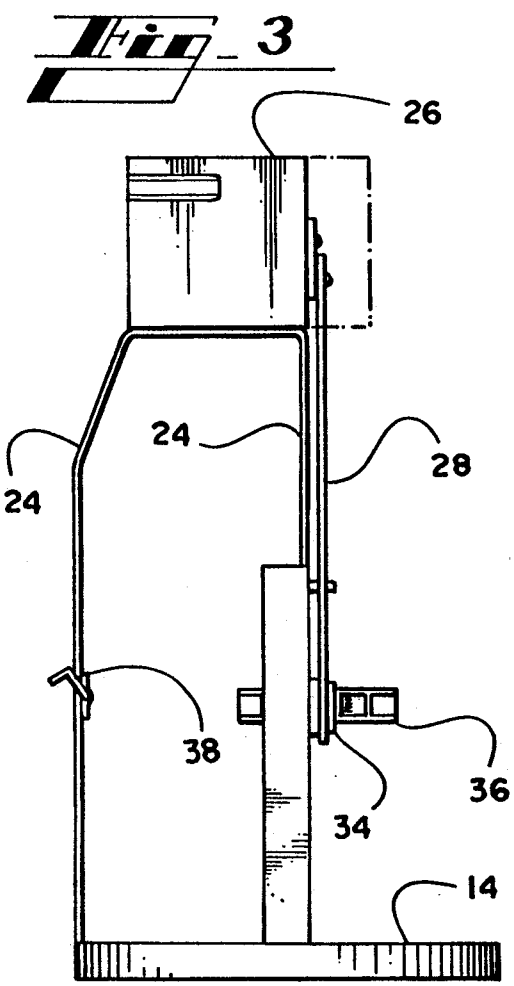
FIG. 3 is diagrammatic side view of the automatic brush cleaner of FIG. 1.

Referring to FIG. 3, a hook 38 is attached to the first end portion of the support member 24 for engaging the rim of the paint bucket to hold the brushes out of the cleaning solution to dry.

Referring to FIGS. 1, 2 and 4, a comb 40 is attached to the horizontal member 20, and is useful for combing the bristles of the brush after cleaning to insure that the bristles are straight and properly aligned.

Referring now to FIG. 4, the brush cleaning apparatus 10 is used by attaching the brushes to be cleaned to the bar 34 with the spring loaded clips 36. For more effective cleaning, the larger brushes are kept near the center of the bar 34. With a five gallon container, about one to one and one half gallons of cleaning solution are placed in the container. The cleaning solution may be soapy water, vinegar, mineral spirits or other solution appropriate for the finish on the brushes to be cleaned. The apparatus with the brushes attached is lowered into the container of solution. The level of cleaning solution is adjusted until the level of the solution comes to the top of the bristles of the largest brush. This practice eliminates sloshing of the cleaning solution. The motor 26 is turned on. Preferably, the motor 26 is equipped with a timer set five, ten or fifteen minutes depending on whether light, medium or heavy cleaning is desired.

When the motor 26 is started, the rotating motion of the motor shaft rotates the crank arm 32 which imparts motion to the top end of the link 28. The motion at the top end of the link 28 is largely circular motion. This circular motion at the top end of the link 28 is translated via slot 30 and pivot pin 22 into an agitating motion of the brushes with the bar 34 up and down slightly and pivoting about its central point. The up, down and side motion of the bar 34 and brushes 12 attached thereto causes the cleaning solution to swirl in a revolving pattern. The cleaning solution swirls to pull paint from the bristles and swishes across the top of the bristles. A downward push of the brush forces cleaning solution up into the bristles. An upward pull of the brush pulls cleaning solution from the bristles. If sloshing of the solution should occur, cleaning solution may be added or subtracted to eliminate the sloshing.

When the motor 26 stops after a preselected time, the unit 10 is raised and the drip hook 38 is placed over the lip of the container. The brushes 12 will drip dry in a vertical position. When the brushes are removed, they are pulled through the comb 40 two or three times while turning the brushes over each time. The speed of the motor should be such that the cleaning solution does not slosh excessively. The motor speed and relative motion of the bar 34, and therefore the brushes, should be matched to minimize sloshing.

Figure 5:
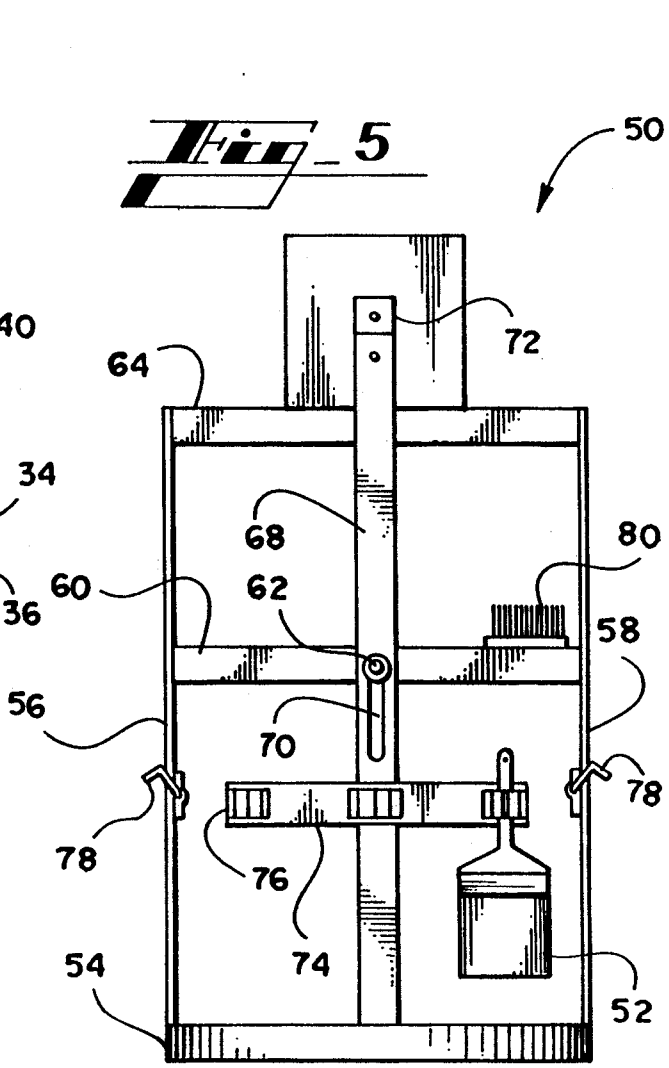
FIG. 5 is diagrammatic front view of the automatic brush cleaner similar to FIG. 2, but illustrating another preferred embodiment.

Referring now to FIG. 5, another embodiment of the present invention is illustrated wherein an automatic brush cleaning apparatus 50 includes a frame for holding brushes 52 that is lowered into a container. The framework includes a base member 54 that rests on the bottom on the container. The base member 54 preferably has a circular configuration. First and second vertical members 56, 58 each have one end attached to the base member 54 and extend vertically from the base member 54. When positioned in a paint bucket or other container, the base member 54 rests on the bottom of the container and the vertical members 56, 58 extend along the sidewall on the container. Preferably, the vertical members 56, 58 are positioned diametrically opposite one another.

A first horizontal member 60 is attached to the first and second vertical members 56, 58, and extends therebetween. As illustrated, the horizontal member 60 has its end portions attached to the middle portions of the upstanding vertical members 56, 58. A pivot member, such as bolt 62, is attached to the middle portion of the horizontal member 60. A second horizontal member 64 is attached to the first and second vertical members 56, 58 at an elevation higher than the first horizontal member 60. A motor 66 is mounted on the second horizontal member 64.

A motion translating link 68 has first and second end portions and a middle portion extending between the first and second end portions. The middle portion of the link 68 has an elongated slot 70 engageable with the bolt 62. The upper end portion of the motion translating link 68 is preferably connected to the rotating motor shaft by a short arm or crank 72. The crank 72 rotates with the motor shaft in a circular pattern and imparts motion to the link 68. The upper end of the link 68 at the point of connection to the crank 72 is also a circular pattern. This circular pattern at the upper most end of the link 68 causes the lower middle portion of the link 68 to move up and down and sideways as the link 68 pivots about the pivot point 62 via the elongated slot 70.

A horizontal bar 74 is attached to the lower end portion of the link 68 and has one or more clips 76 attached thereto for holding the brushed to be cleaned.

Hooks 78 are attached to the vertical members 56, 58 for engaging the rim of the paint bucket to hold the brushes out of the cleaning solution to dry.

A comb 80 is attached to either of the horizontal members 60, 64 and is useful for combing the bristles of the brush after cleaning to insure that the bristles are straight and properly aligned.

The brush cleaning apparatus 50 is used by attaching the brushes to be cleaned to the bar 74 with the spring loaded clips 76. When the motor 66 is started, the rotating motion of the motor shaft rotates the crank arm 72 which imparts motion to the top end of the link 68. The motion at the top end of the link 68 is largely circular motion. This circular motion at the top end of the link 68 is translated via slot 70 and pivot pin 62 into an agitating motion of the brushes with the bar 74 up and down slightly and pivoting about its central point. The up, down and side motion of the bar 74 and brushes 52 attached thereto causes the cleaning solution to swirl in a revolving pattern. The cleaning solution swirls to pull paint from the bristles and swishes across the top of the bristles. A downward push of the brush forces cleaning solution up into the bristles. An upward pull of the brush pulls cleaning solution from the bristles. When the motor 66 stops after a preselected time, the unit 50 is raised and the drip hooks 38 are placed over the lip of the container. The brushes 52 will drip dry in a vertical position. When the brushes are removed, they are pulled through the comb 80 two or three times while turning the brushes over each time.

It will be now appreciated that there has been presented a brush cleaning apparatus that quickly and easily cleans paint brush bristles immediately after use to thereby eliminate the need to wrap the bristles and reduce the possibility of damage. A painter can now quickly and easily clean paint brush bristles between colors in a short period of time to minimize loss of productivity. The automatic brush cleaner that minimizes splashing of the solvent and minimizes exposure time to the vapors. The brush cleaner can be used in a vehicle to conveniently clean brushes between jobs, and is easy to transport from one jab site to another. The paint brush cleaner does not splash the cleaning solution, operates automatically, and does not rely on uncertain mechanical labor or messy electric drills.

While the invention has been described with particular reference to a preferred embodiment, it will be understood by those skilled in the art that various changes may be made and equivalents may be substituted for elements of the preferred embodiment without departing from invention. For example, while the invention has been described as constructed of metal, it could also be constructed of synthetic resins or composite materials. Also, the vertical members 16, 18 and 56, 58 may form a tapered configuration to facilitate easy insertion into a paint bucket and easy removal therefrom. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. For example, the motor may be an AC or DC motor, and may be operated from house current or a vehicle battery. It is accordingly intended that the claims shall cover all such modifications and applications as do not depart from the true spirit and scope of the invention.

I claim:

1. A brush cleaning apparatus, comprising:
a base member;
a first vertical member attached to said base member and extending vertically therefrom;
a second vertical member attached to said base member and extending vertically therefrom and being spaced a preselected distance from said first vertical member;
a first horizontal member attached to said first and second vertical members and extending therebetween, said first horizontal member having a middle portion;
a pivot pin connected to said middle portion of said first horizontal member and protruding therefrom;
a link having a first end portion, a second end portion, and a middle portion extending between said first and second end portions, and having an elongated slot engageable with said pivot pin with said link being pivotally movable about said pivot pin;
means for attaching at least one brush to said first end portion of said link; and
means for imparting motion to said second end of said link so that said link pivotally moves about said pivot pin.

2. A brush cleaning apparatus, as set forth in claim 1, wherein said base member is circular and said first and second vertical members are diametrically opposite one another.

3. A brush cleaning apparatus, as set forth in claim 1, including a hook connected to one of said first and second vertical members.

4. A brush cleaning apparatus, as set forth in claim 1, wherein said means for means for attaching at least one brush to said first end portion of said link includes a clip attached to said first end portion of said link.

5. A brush cleaning apparatus, as set forth in claim 1, wherein said means for means for attaching at least one brush to said first end portion of said link includes:
a bar connected to said first end portion of said link; and
at least one clip attached to said bar.

6. A brush cleaning apparatus, as set forth in claim 1, wherein said means for imparting motion to said second end of said link includes a motor connected to said first and second vertical members.

7. A brush cleaning apparatus, as set forth in claim 1, wheerein rotating motion is imparted to said second end of said link, and said slot acting concert with said pivot pin translates said rotating motion to pivotal motion at said first end potion of said link.

8. A brush cleaning apparatus, as set forth in claim 1 including a second horizontal member attached to said first and second vertical members and extending therebetween and being spaced from said first horizontal member a preselected distance.

9. A brush cleaning apparatus, as set forth in claim 1, including a comb mounted on said horizontal member.

10. A brush cleaning apparatus, comprising:

a base member;

a first vertical member attached to said base member and extending vertically therefrom;

a second vertical member attached to said base member and extending vertically therefrom and being spaced a preselected distance from said first vertical member;

a horizontal member attached to said first and second vertical members and extending therebetween, said horizontal member having a middle portion;

a pivot pin connected to said middle portion of said horizontal member and extending therefrom;

a support member having a first end portion connected to said base member and extending vertically therefrom, a second end portion connected to said middle portion of said horizontal member and extending vertically therefrom, and a middle portion extending horizontally between said first and second end portions of said support member;

a link having a first end portion, a second end portion, and a middle portion extending between said first and second end portions and having an elongated slot engageable with said pivot pin with said link being pivotally movable about said pivot pin;

means for attaching at least one brush to said first end portion of said link; and means for imparting motion to said second end of said link so that said link pivotally moves about said pivot pin.

11. A brush cleaning apparatus, as set forth in claim 10, wherein said base member is circular and said first and second vertical members are diametrically opposite one another.

12. A brush cleaning apparatus, as set forth in claim 11, wherein said first end portion of said support member is attached to said base member at a location approximately halfway between said first and second vertical members.

13. A brush cleaning apparatus, as set forth in claim 10, including a hook connected to said first end portion of said support member.

14. A brush cleaning apparatus, as set forth in claim 10, wherein said means for means for attaching at least one brush to said first end portion of said link includes a clip attached to said first end portion of said link.

15. A brush cleaning apparatus, as set forth in claim 10, wherein said means for means for attaching at least one brush to said first end portion of said link includes:

a bar connected to said first end portion of said link; and at least one clip attached to said bar.

16. A brush cleaning apparatus, as set forth in claim 10, wherein said means for imparting motion to said second end of said link includes a motor mounted on said middle portion of said support member.

17. A brush cleaning apparatus, as set forth in claim 10, including a comb mounted on said horizontal member.

18. A brush cleaning apparatus, as set forth in claim 10, wherein rotating motion is imparted said second end of said link, and said slot acting concert with said pivot pin translates said rotating motion to pivotal motion at said first end potion of said link.

* * * * *